US006571495B1

(12) United States Patent
Margaronis

(10) Patent No.: US 6,571,495 B1
(45) Date of Patent: Jun. 3, 2003

(54) SIGN

(76) Inventor: Mihail Antonios Margaronis, 9 Colburn Dr., Suite 3b, Orono, ME (US) 04006

( * ) Notice: Subject to any disclaimer, the term of this patent is extended or adjusted under 35 U.S.C. 154(b) by 0 days.

(21) Appl. No.: 09/500,256

(22) Filed: Feb. 8, 2000

(51) Int. Cl.[7] ..... G09F 11/02
(52) U.S. Cl. ..... 40/473; 40/493; 40/506
(58) Field of Search ..... 40/473, 493, 506

(56) References Cited

U.S. PATENT DOCUMENTS

| | | | | |
|---|---|---|---|---|
| 715,226 | A | | 12/1902 | Weisenfeld |
| 796,559 | A | * | 8/1905 | Bradshaw |
| 858,452 | A | * | 7/1907 | Harding |
| 1,237,502 | A | * | 8/1917 | Bonzales |
| 1,378,538 | A | * | 5/1921 | Garson |
| 1,637,988 | A | * | 8/1927 | Egan |
| 1,740,845 | A | * | 12/1929 | Tilbe |
| 4,021,946 | A | * | 5/1977 | Bradshaw |
| 4,490,932 | A | | 1/1985 | McIntire |
| 5,054,219 | A | | 10/1991 | Hoyt et al. |
| 5,531,453 | A | * | 7/1996 | Penston, III |
| D380,011 | S | * | 6/1997 | Pettus |
| 5,894,261 | A | * | 4/1999 | Green |

* cited by examiner

*Primary Examiner*—Cassandra H. Davis
(74) *Attorney, Agent, or Firm*—Patricia M. Mathers; Thomas L. Bohan

(57) ABSTRACT

A combination advertising/public-information sign intended for use in public areas such as railroad stations and city squares, especially for those jurisdictions that permit advertising signs only if associated with the providing of information of general public interest. The sign is light in weight and easy to assemble and disassemble. The public information and advertisements presented on the sign are in continuous motion and are readily viewable at any given time by the vast majority of the persons within sight of the device.

7 Claims, 3 Drawing Sheets

SIGN

BACKGROUND OF THE INVENTION

1. Field of the Invention

The present invention relates to advertising. More particularly, the present invention relates to apparatus for displaying advertisements in combination with the display of desirable public information. More particularly yet, the present invention relates to multi-faced, continuously-rotating apparatus having public information and advertising in view at all times. Most particularly, the present invention relates to such apparatus that is relatively light in weight and easy to assemble and disassemble.

2. Description of the Prior Art

The continually increasing industrialization, commercialism and resulting competition for attention in modern society has fueled the need for ever-more inventive modes of advertising. Over the past century, a great variety of advertising-display devices have been developed, ranging from the Mail Pouch broadsides on barns in rural America to the giant-size smoke rings formed in real time high on the "Flatiron" Building in Manhattan's Times Square. Indeed, representative of a certain type of advertising context, those cigarette-advertising smoke rings were situated directly above a moving-letters news display that proved very efficient in getting persons in Times Square to look up and, as a consequence, to take in the advertisement. It is reasonable, then, that businesses interested in getting potential customers to view their advertising copy would also be interested in combining their advertisements with non-commercial information of interest to the public and simultaneously with eye-catching motion, even if those businesses are not of the size that can afford to buy space in Times Square or the like. In seeking to provide such a context for their advertisements, these smaller businesses also have to operate within the ever-tighter regulatory atmosphere that now prevails for commercial messages, as discussed below. The regulations creating this atmosphere have greatly reduced the availability of advertising venues at the very time that new businesses—large and small—seeking to capture the public's attention have exploded in number. It is necessary, therefore, to take advantage of every niche left available for advertising in public spaces. In many locations, the only kind of advertising display that is allowed is that which displays public information along with the advertising copy. The demand for advertising displays incorporating public information is thus driven both by the advertiser's interest in capturing the public's fleeting attention and by the need to gain permission in the first place to set out the advertising display.

Wiesenfeld (U.S. Pat. No. 715,226; issued 1902) teaches a device containing a clock at the top of a column and a rotating advertising display section at the base of the column. Although the advertising-display section is capable of displaying multiple advertisements and of rotating, it is not readily viewable in a large crowd, the precise environment in which the advertiser would like to place it. Furthermore, the clock of the Wiesenfeld device is not multi-faced and does not rotate; as a result, it will attract the attention of only those people who are within a 90-degree sector with respect to the device.

McIntire (U.S. Pat. No. 4,490,932; issued 1985) discloses a cabinet-resembling advertising sign support that houses two separate rotating axles for presenting multiple advertisements seriatim.. The display of the McIntire device is coupled with a stationary central sign board. A hinged, convex, semi-circular piece overlying the top wall of the McIntire device includes a single-faced stationary clock. The McIntire device appears bulky, heavy and expensive, and therefore unlikely to be utilized by smaller businesses or traveling vendors for whom transportability and low cost are essential. Another major drawback of this cabinet device of McIntire is that at any given time most of the advertisements are within a cabinet, awaiting their turn to be displayed, and therefore not visible to the target public.

Hoyt et al. (U.S. Pat. No. 5,054,219; issued 1991) teaches a four-faced, illuminated advertising display that can be mounted on an existing sign post Once mounted, the display revolves around a stationary pole by means of an internal drive mechanism. The Hoyt et al. device does not provide for the display of any attention-grabbing public information that would lead the potential customers to be exposed to the advertising messages. It depends, rather, on the movement of the cube to draw public attention. Although this provides a gimmick that is useful as an attractant, it will not satisfy those codes that only permit advertising displays that are coupled with non-commercial information of general interest to the public.

Therefore, what is needed is an advertising device that is lightweight, transportable, sturdy, and aesthetically pleasing. What is further needed is such a device that combines desirable public information with the capacity to present a multiplicity of commercial messages (advertisements). What is still further needed is such a device on which both the public information and the commercial messages are readily viewable at any given time by the vast majority of persons in large crowds surrounding and/or passing by the device. Finally, what is needed is such a device that is readily assembled and disassembled, and affordable for small businesses.

SUMMARY OF THE INVENTION

It is an object of the present invention to provide an advertising device that is lightweight, transportable, sturdy, and aesthetically pleasing. It is a further object of the present invention to provide such a device that combines desirable public information with the capacity to present a multiplicity of advertisements. It is a yet further object of the present invention to provide such a device on which both the public information and the advertisements are readily viewable at any given time by the vast majority of the persons within device that is readily assembled and disassembled, and affordable for small businesses.

The device of the present invention consists in major part of two modules, a public-news module and an advertising module, supported by a vertical shaft, a base support, and a rotational drive mechanism. Where possible, all components—in particular, the components of the public-news module and the advertising module—are fabricated from lightweight materials such as aluminum and plastic. The public-news module is roughly cubic in shape, and may be framed in with aluminum or plastic "angle-irons." The public-news module has a number of roughly planar transparent, translucent, or electronic side panels through or by which public news, such as time and temperature, news, schedules, etc., can be displayed. In a typical embodiment, a temperature display on each side panel can be linked to a remote sensor, or to a sensor located at or near the device itself. In another typical embodiment, multiple clocks, or a single clock with multiple faces, may be placed within the public-news module, so that the current time may be viewed on any of the planar side panels. In still another embodiment, electronic-display side panels controlled by computer may show local public transportation schedules. The public-news module is constructed in such manner as to prevent its contents from being damaged by rain or other weather elements or, alternatively, if the device is to be used indoors, less attention and fewer resources need be paid to making this and the other modules weather-proof.

The advertising module is usually positioned directly below, and typically joined to, the public-news module on the device. The advertising module will also contain a plurality of translucent, transparent, or electronic (e.g., plasma) planar side panels. Unlike the panels in the public-news module, these side panels will be, in general, of greater length in the vertical dimension than in the horizontal. They will, therefore, form rectangles with the long side in the vertical direction. Access means will be provided by which to place and replace particular advertising copy into each of the side panels on the advertising module. In a typical embodiment, each panel will display different advertising copy. The module may also be illuminated from the inside, so as to provide illumination to the advertisements, or, alternatively, electronic side panels will each provide its own illumination source.

A central shaft of the device of the present invention extends vertically from a base support, the ground, or the floor up to the public-news and advertising modules. The central shaft holds the two modules aloft, above the general traffic and scenery of the device's location, so that, generally, the public-news module and the advertising module can be seen by all persons in the vicinity at all times.

The rotational drive mechanism may be located in a base supporting the shaft. In such an embodiment, the public-news module and advertising module are fixed atop the shaft, and the rotational drive mechanism turns the vertical shaft, thereby rotating the modules. In other embodiments, the rotational drive mechanism may be at or near the top of the vertical shaft, within or as part of the public-news module and/or advertising module. In such embodiments, the public-news module and advertising module rotate about the central shaft on a bearing component, and the rotational drive mechanism is fixed to the vertical shaft and turns the public-news module and advertising module, or the rotational drive mechanism is fixed to the public-news and advertising modules and turns itself around the vertical shaft. The rotational drive mechanism consists of a motor and a transmission components, such as gears, wheels, belts, or a chains.

The device of the present invention, depending on its particular embodiment, is intended to be placed in airports, shopping centers, commuter/train/bus concourses, etc. In these areas aesthetics are key, space is limited, and there is no room for oversized or unsightly advertisement displays. Further, these large open areas are environments to which the present invention caters, because it is readily seen from all sides by many passersby. One could envision, for example, the present invention located in the main concourse area of a busy airport wherein the current time, as well as the time for other frequently traveled time zones, is displayed along with advertisements for some of the airport shops. Likewise, the present invention located in a busy commuter train station could display from every direction the boarding time and track of departure for specific trains on all panels of the public-news module, while presenting a series of advertisements for local businesses as the advertising module rotated. In both situations, a passerby who is departing, arriving, or meeting a passenger would be likely to study the device for its public information and thereby become exposed to the advertisements that hove into view during the time required to take in the desired information. Because of the access means provided in the device of the present invention, an attendant could easily replace, on the spot, new advertisements for ones that had been on display for their allotted time.

The device of the present invention differs from the prior-art in a number of important ways. In particular, unlike the device of Wiesenfeld, the present device combines a multi-sided advertising and clock display that is elevated from the floor and readily viewable from all sides. Further, the device of the present invention differs from the McIntire device in that each of its public-information panels and advertisements is viewable from some direction at all times, while the overall design and construction of the device conserves space and remains attractive. Still further, the device of the present invention differs from the Hoyt et al. device in that all of the components necessary to operate the device are included, and in that the device utilizes general public information to draw the attention of the potential consumer so as to provide this device entrance to areas that are barred to all advertising devices not providing generally useful, non-commercial. information. These and other advantages of the present invention will become evident upon a review of the drawings, the detailed description of the preferred embodiment, and the claims below.

DETAILED DESCRIPTION OF THE PREFERRED EMBODIMENT

Figure 1:
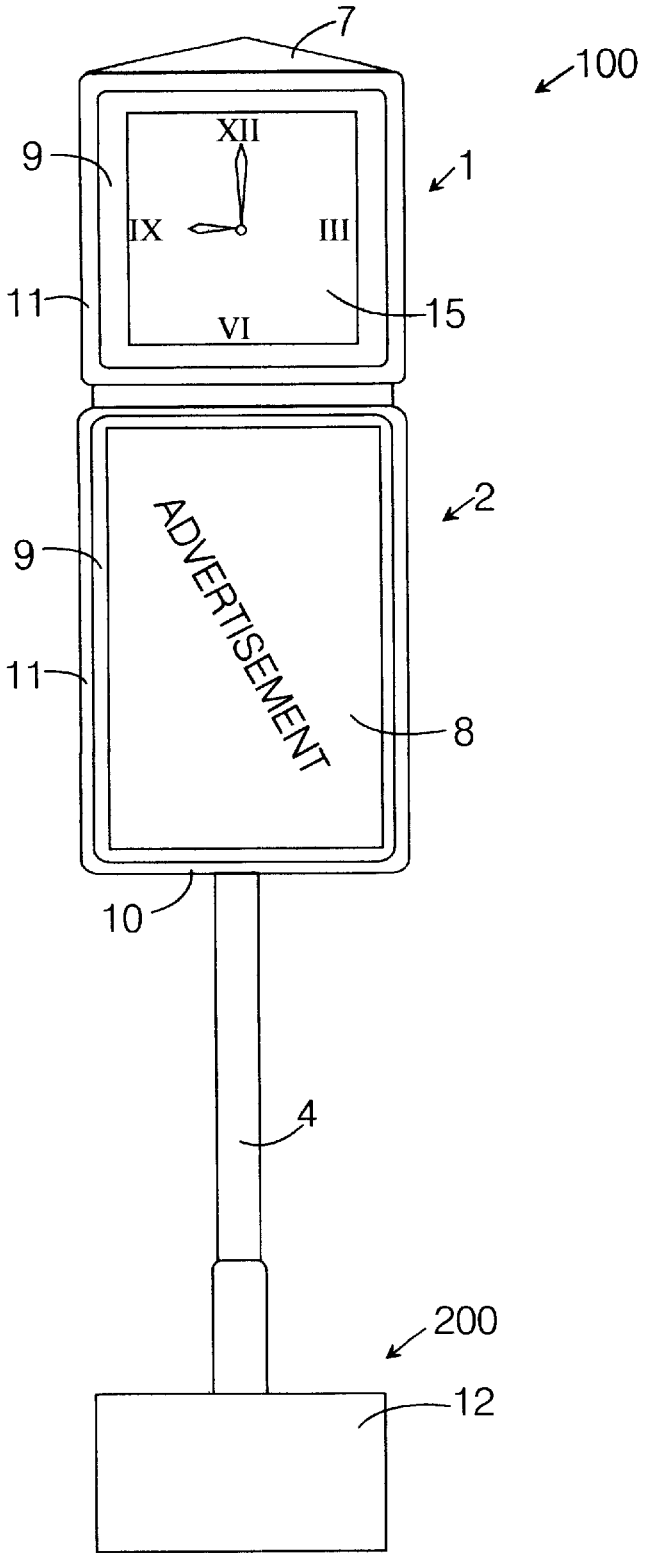
FIG. 1 is a perspective view of the preferred embodiment of the present invention showing its clock and advertising components, and its base and shaft.
Figure 2:
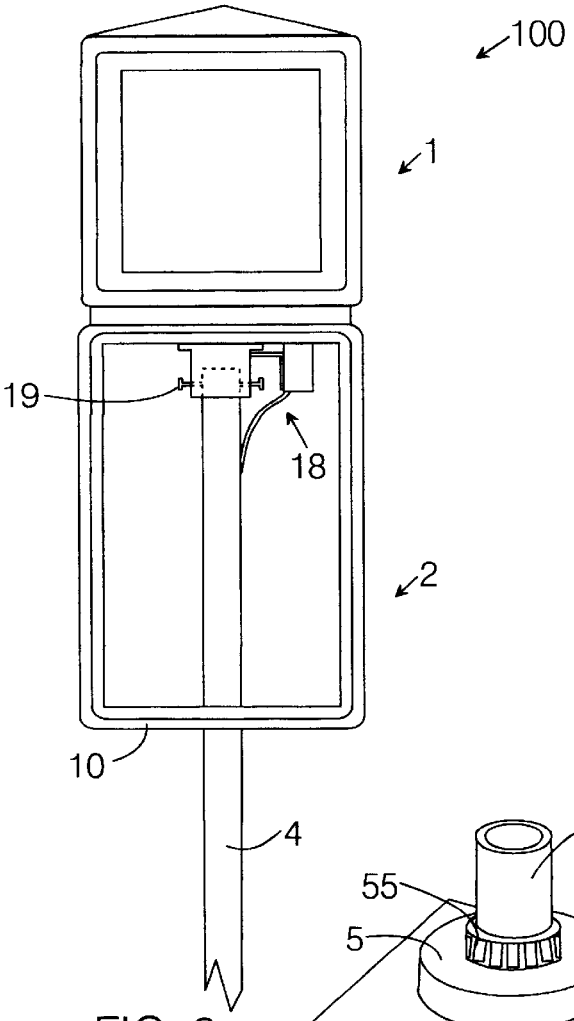
FIG. 2 is a perspective view of the preferred embodiment of the present invention having a cut-away view of the advertising cube showing the rotational drive assembly and its engagement with the clock and advertising components.

The general arrangement of the preferred embodiment of the present invention is illustrated in FIG. 1. A rotating information/advertising unit 100 is held aloft by a supporting unit 200. The rotating information/advertising unit 100 consists of a clock display cube 1 mounted above the advertising module 2. Joining the clock display cube 1 and the advertising module 2 is a spacer assembly 3 to which the bottom of the clock display cube 1 and the top of the advertising. module 2 are fastened. The supporting unit 200 consists of vertical support shaft 4 fixedly anchored to a base support 12. The vertical support shaft 4 extends upward, through a bottom plane 10 of the advertising module 2. As can be seen in FIG. 2, the vertical support shaft 4 extends through the essentially hollow advertising module 2. A rotational drive assembly 18 is removably fixed to the top of the vertical support shaft 4, held in place with a plurality of threaded set screws 19. The rotational drive assembly 18 engages the spacer assembly 3 thereby supporting the entire rotating information/advertising unit 100.

Figure 5:
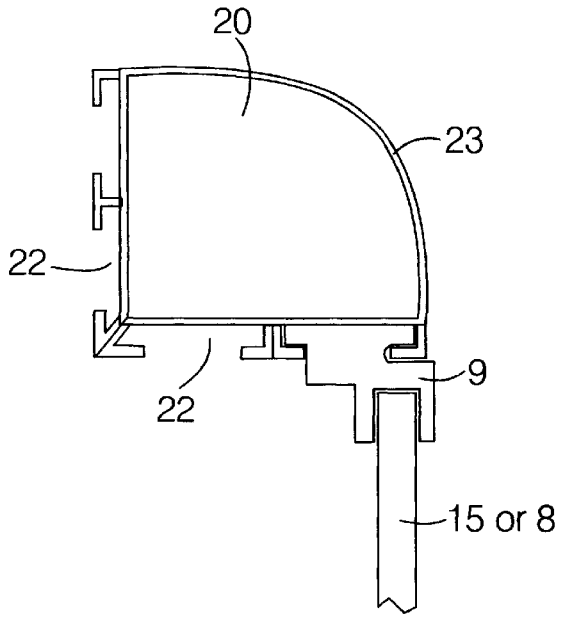
FIG. 5 is a detail view of a section the structural frame and track components.

A structural frame 11 for the clock display cube 1 and the advertising module 2 are best viewed in FIG. 1. A detail of the structural frame 11 is shown FIG. 5. The structural frame 11 is made of lengths of aluminum track bar 20 of a commonly available type having a roughly quarter-circular cross-section with the round face 23 forming the outer edges of the structural frame 11, and the flat faces being the inside faces 22 of the structural frame 11. The lengths of aluminum track bar 20 are joined at the comers with threaded screws so that the frame is easily assembled and disassembled. The inside faces 22 of the aluminum track bar 20 that frame a vertical side of the structural frame 11 hold an aluminum track 9. For purposes of illustration, only one aluminum track 9 is shown.

The four vertical sides of the clock display cube 1 are each about three feet square. With reference to FIG. 1, each vertical side is a clock 15, its face held in place in the structural frame 11 by the aluminum track 9. The. face of each of the four clocks 15 is protected by a transparent rigid cover. The clock display cube 1 is equipped with a roof 7 that is provided with a pitch of approximately fifteen degrees. The roof 7 provides shelter for the internal components of the information/advertising module 100 and is easily removable to provide access into the mechanisms of the clocks.

The advertising display module 2 is about three feet wide by five feet high. Each vertical side consists of an advertising panel 8 held in place in the structural frame 11 by the aluminum track 9. Each of the four advertising panels 8 contains a different advertisement. The aluminum track bar 20 forming the bottom edges of the advertising display module 2 at the bottom plane 10 is removable, so that each advertising panel 8 may be easily removed and replaced by another.

Figure 3:
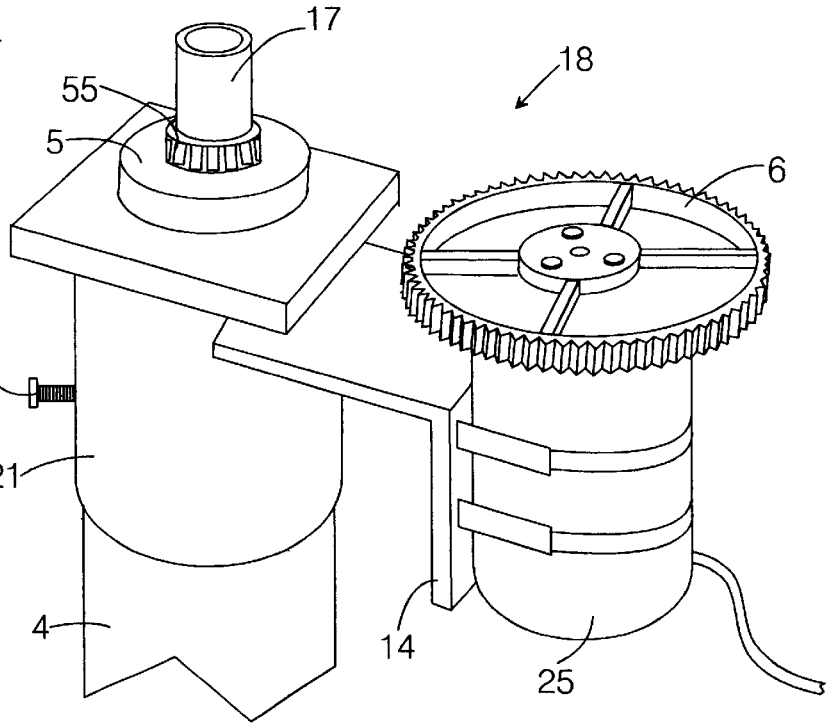
FIG. 3 is a detail view of the rotational drive assembly.
Figure 4:
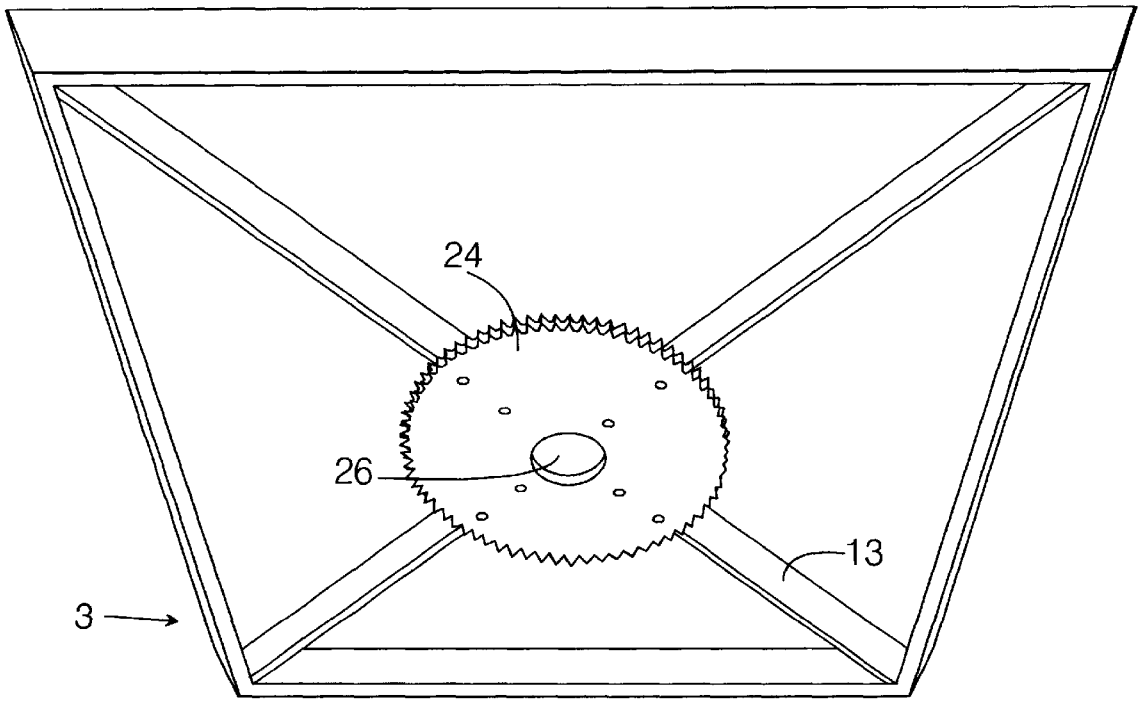
FIG. 4 us a detail view of the spacer assembly.

FIG. 2 gives a cut-away view of the advertising module 2, showing the vertical support shaft 4 passing through the bottom plane 10 of the advertising module 2 and engaging the spacer assembly 3 by means of the rotational drive assembly 18. FIG. 3 and FIG. 4 show details of the rotational drive assembly 18 and the spacer assembly 3, respectively. As shown in FIG. 3, the rotational drive assembly 18 includes a metal cap 21 that fits over the top of the vertical support shaft 4 (in the manner shown in FIG. 2). The metal cap 21 has threaded set screws 19 installed through its side to secure it to the vertical support shaft 4. The metal cap 21 is topped with a support plate 16, in the center of which is an oil and grease cup 5 having a central spindle 17. A set of roller bearings 55 fits in the oil and grease cup 5 around the central spindle 17. A motor mounting bracket 14 extends horizontally away from the side of the metal cap 21. And electric motor 25 is secured to the motor mounting bracket 14 so that its drive shaft is oriented vertically, parallel with the vertical support shaft. A transmission gear 6 is affixed to the drive shaft of the electric motor 25. The electric motor 25 is interruptibly connected to a source of electricity.

As shown in FIG. 4, the spacer assembly 3 is a four-sided aluminum frame having diagonal cross-members 13 joining opposite comers. Horizontally fixed to the bottom of the diagonal cross-members 13, at their intersection at the center of the spacer assembly 3, is drive gear 24. The drive gear has a tapered engagement hole 26 milled to a bearing surface that fits over the spindle 17 and roller bearings 55 of the rotational drive assembly 18.

Thus, with reference to FIG. 2, the rotational drive assembly 18 engages the spacer assembly 3 within the information/advertising unit 100 so that the spindle 17 and roller bearings 55 fit into the tapered engagement hole 26 of the second drive gear 24 to provide support, stability, and a rotational interface, and the first drive gear 6 engages the second drive gear 24 so that the electric motor 25 turns the information/advertising unit. The first drive gear 6 is small with respect to the second drive gear 24 in such proportion as cause the information/advertising unit to turn at a rate of approximately one rotation per minute.

The preferred embodiment of the present invention should be considered as merely illustrative. As numerous modifications and changes will readily occur to those skilled in the art, it is not desired to limit the invention to the exact construction and operation shown and described herein. Accordingly, all suitable modifications may serve a particular purpose while still employing the unique concepts set forth in the SUMMARY.

I claim:

1. A three-dimensional, continuously rotating sign comprising a display unit, a base supporting structure, and a motor and transmission unit, wherein said display unit comprises an upper public information module, a support spacer, and a lower advertising module and has a bottom edge;

wherein said upper public information module is essentially hollow and has a plurality of vertical sides, all of which display identical information of interest to the general public; and wherein said lower advertising module is essentially hollow and has a plurality of vertical sides, each of which has a panel containing commercial advertising and an easily removable bottom structure that allows for quick replacement of said panel; and wherein said support spacer is a base support and stabilizer for said display unit, said support spacer being mounted between said upper public information module and said lower advertising module, and said support spacer incorporating an engagement interface that engages the base supporting structure and a fixed drive gear;

wherein said base supporting structure comprises a wide stabilizing base that is placed on a support surface, said wide stabilizing base mechanically holding upright a vertical shaft of sufficient length to raise said bottom edge of said display unit a minimum of six feet above said support surface;

wherein said motor and transmission unit comprises a mounting means, a support plate; an engagement spindle, a motor mounting bracket, an electric motor, and a transmission gear;

wherein said mounting means removably secures said motor and transmission unit to an upper end of said vertical shaft;

wherein said support plate is fixed horizontally atop said mounting means;

wherein said engagement spindle rises vertically from said support plate;

wherein said engagement spindle and support plate engage said engagement interface of said support spacer and thereby prevent side-to-side motion of said support spacer and keep said support spacer horizontally oriented;

wherein said motor mounting bracket is fixed below said support plate and extends horizontally away from said mounting means;

wherein said electric motor, having a drive shaft, is removably secured to said motor mounting bracket so that said drive shaft is oriented vertically, parallel to said vertical shaft;

wherein said transmission is fixed to said drive shaft so that the plane of said transmission gear is horizontal;

wherein said motor mounting bracket, electric motor, and transmission gear are assembled so that, when said support plate and said engagement spindle engage said engagement interface of said support spacer, said transmission gear engages said drive gear of said support spacer and thereby transmits a rotation of said electric motor to said support spacer, said rotation being about a vertical axis; and wherein said electric motor is interruptibly connectable to a source of electric power.

2. The device of claim 1 wherein the display unit has a roof and is weather-tight.

3. The device of claim 1 wherein said support spacer is fixedly mounted to the top of said upper public information module.

4. The device of claim 1 wherein said advertising module is illuminated from within and said panels containing commercial advertising are translucent.

5. A three-dimensional sign comprising:

a display unit that includes a public information section, an advertising section, and a spacer assembly;

a support assembly; and a drive assembly that includes a motorized gear assembly and a bearing assembly;

wherein said support assembly includes a base placed on a support surface, and a vertical shaft;

wherein said spacer assembly has an outer perimeter, an upper surface, a lower surface, and an undersurface, wherein said public information section is mounted to said outer perimeter at said upper surface of said spacer assembly and said advertising section is mounted to said outer perimeter at said lower surface;

wherein said motorized gear assembly is mounted at an upper end of said vertical shaft and said bearing assembly is mounted on said undersurface of said spacer assembly, wherein said bearing assembly engages with said motorized gear assembly, and wherein, when said motorized gear assembly is energized, said drive assembly causes said display unit to rotate about said vertical shaft.

6. The sign of claim 5 wherein said display unit is rectangular in shape and said advertising section comprises a frame and four panels, wherein each of said four panels is removably assembled in said frame.

7. The sign of claim 6, wherein each of said four panels contains a different advertisement.

* * * * *